United States Patent [19]

Lugscheider et al.

[11] Patent Number: 4,493,088

[45] Date of Patent: Jan. 8, 1985

[54] PLASMA MELTING FURNACE

[75] Inventors: Walter Lugscheider, Linz; Helmut D. Kilches, Asten; Ernst Riegler, Enns; Ernst Zajicek, Ottensheim, all of Austria

[73] Assignee: Voest-Alpine Aktiengesellschaft, Linz, Austria

[21] Appl. No.: 336,901

[22] Filed: Jan. 4, 1982

[30] Foreign Application Priority Data

Jan. 13, 1981 [AT] Austria ..... 99/81

[51] Int. Cl.[3] ..... F27D 1/00; F27D 7/00

[52] U.S. Cl. ..... 373/22; 373/75

[58] Field of Search ..... 373/22, 23, 24, 72, 373/88, 90, 44, 54, 75

[56] References Cited

U.S. PATENT DOCUMENTS 1,385,411 7/1921 vom Baur .
2,744,944 5/1956 Striplin, Jr. et al. ..... 373/72 X
3,400,208 9/1968 Franzen .
3,828,107 8/1974 Sone ..... 373/22
3,834,895 9/1974 Cachat .

FOREIGN PATENT DOCUMENTS 1219181 11/1964 Fed. Rep. of Germany .
1239232 10/1959 France .
109789 2/1974 German Democratic Rep. .
2037412 7/1980 United Kingdom .

*Primary Examiner*—Roy N. Envall, Jr.
*Attorney, Agent, or Firm*—Brumbaugh, Graves, Donohue & Raymond

[57] ABSTRACT

A plasma melting furnace includes one or more plasma burners penetrating the furnace lining, in particular a plasma burner projecting vertically into the interior of the furnace. In order to ensure a most uniform stress on the lining by the heat radiation, the inner surface of the lining is designed to be inclined, converging upwardly.

3 Claims, 4 Drawing Figures

PLASMA MELTING FURNACE

BACKGROUND OF THE INVENTION

The invention relates to a plasma melting furnace comprising one or more plasma burners penetrating the furnace lining, in particular a plasma burner projecting vertically into the interior of the furnace.

With known plasma melting furnaces the brickwork is made cylindrical. The thermal energy radiation coming from the plasma jet involves a big stress on the lining. The thermal radiation dissipating onto the cylindrical lining in a plane perpendicular to the axis of the cylindrical brickwork is reflected in this plane by the brickwork, causing a very high temperature stress and thus a strong temperature increase of the lining in a band region of the lining lying in this plane. In practice, this has lead to a premature termination of the furnace campaign, since in particular the zone in the region of the lining closely above the bath level of the furnace is thermally overstressed. The remaining part of the lining would still be useful; the overstressed part of the lining, however, has to be restored prematurely. This band-like damage of the lining, to a particularly great extent, occurs in the lining of small plasma melting furnaces in which the plasma burner projects vertically into the interior of the furnace, because the strongest heat radiation is perpendicular to the axis of the plasma jet.

SUMMARY OF THE INVENTION

The present invention aims at avoiding these disadvantages and difficulties, and has as its object to provide a plasma furnace of the initially-defined kind, in which the lining is subjected to a most uniform stress by heat radiation and thus to a most uniform stress.

This object is achieved according to the invention in that the inner surface of the lining is designed to be inclined, converging upwardly.

According to a preferred embodiment, the convergent angle $\alpha$ is between 5° and 15°, and in particular, betweeen 5° and 10°.

BRIEF DESCRIPTION OF THE DRAWINGS

The invention will now be explained in more detail with reference to the accompanying drawings, wherein.

DETAILED DESCRIPTION OF THE DRAWINGS

Figure 1:
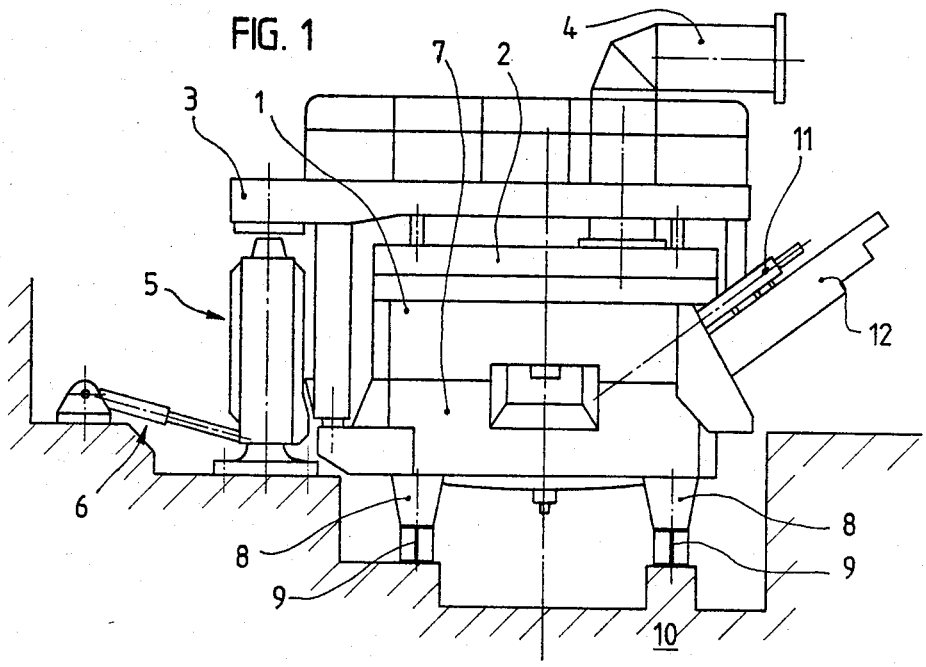
FIG. 1 is a side view of a plasma melting plant incorporating the present invention
Figure 2:
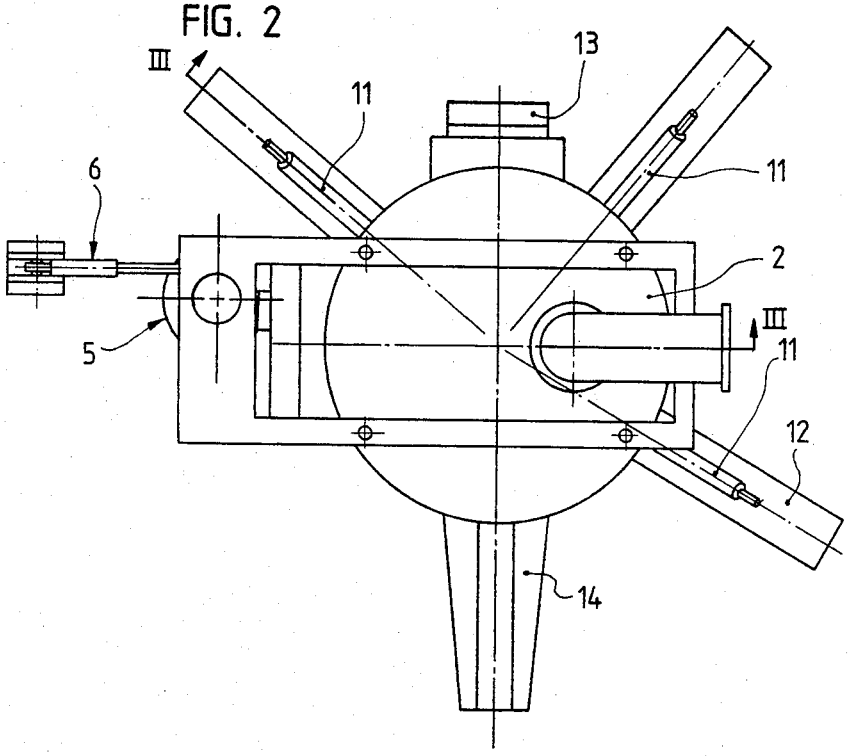
FIG. 2 is a ground view of the plasma melting plant shown in FIG. 1.

A furnace upper section 1 of a plasma melting furnace, in particular a plasma primary melting furnace, is provided with a cover 2 carried by a cover carrying structure 3. From the cover a flue gas bend 4 projects to an exhaust (not illustrated). Laterally beside the furnace upper section 1, the cover lifting means 5 and the cover pivoting means 6 are arranged. The furnace lower section 7, via movable beams 8, rests on running paths 9 supported on the base 10. Each of the three plasma burners 11 is displaceably mounted on an oblique burner mechanism 12.

The slag door is denoted by 13 and the pouring spout is denoted by 14.

Figure 3:
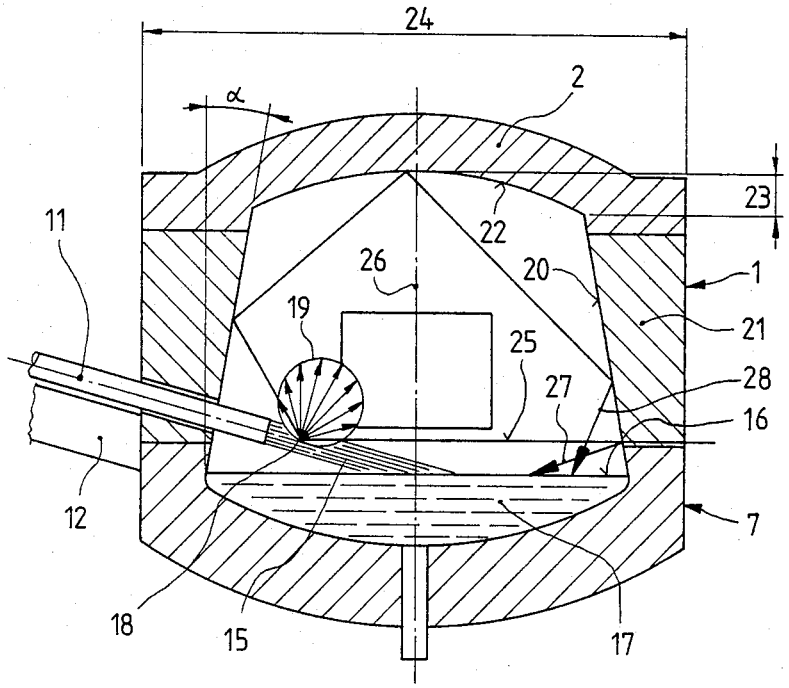
FIG. 3 is a simplified schematic sectional view along the line III—III of FIG. 2 through the furnace vessel.

As can be seen from FIG. 3, the plasma jet 15 emerging from the plasma burner 11 is directed obliquely to the bath surface 16 of the steel bath 17. The heat radiation is figuratively illustrated by a sphere 19 in one point 18 of the plasma jet 15.

The inner surface 20 of the refractory lining 21 of the furnace is conical and inclined, converging upwardly, the angle of inclination $\alpha$ of the inner surface 20 of the refractory lining 21 being within a range of 5° and 15° relative to the vertical. In the embodiment illustrated $\alpha$ is 10°. The inclination of the inner surface of the lining reaches to the cover 2. The cover itself is designed to be vaulted on its inner side 22, the pitch 23 amounting to about 10% of the cover diameter 24.

As can be seen from FIG. 3 by way of the arrow 27, the heat radiation, which dissipates horizontally, i.e. in a plane 25 perpendicular to the axis 26 of the furnace vessel, is reflected against the bath 17 where the still present residual energy leads to an additional heating of the bath. By way of further arrow 28, the reflection of an upwardly directed heat ray is illustrated. The ray, which is reflected three times, also reaches the bath 17.

Figure 4:
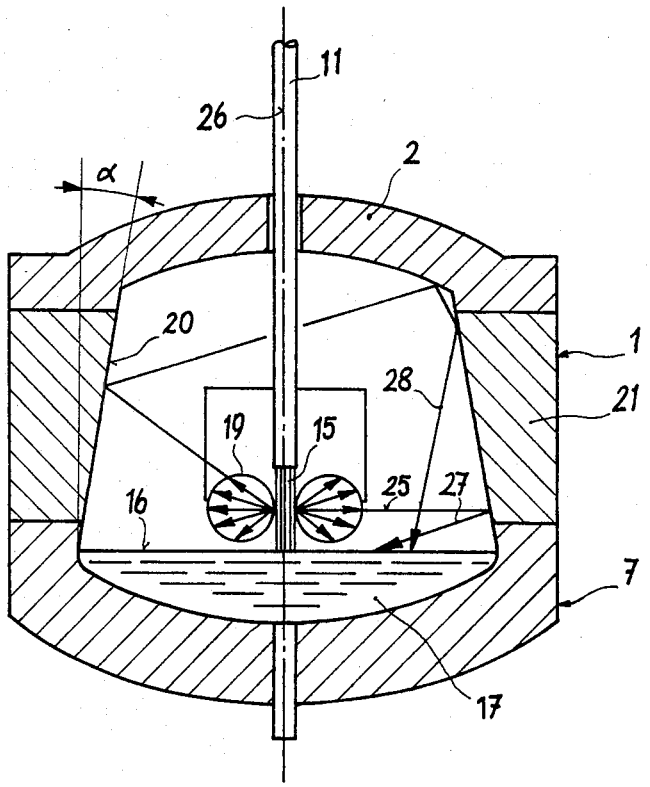
FIG. 4 is a simplified schematic view, analogous to FIG. 3, of an alternative embodiment with a plasma burner vertically projecting into the interior.

As can be seen from FIG. 4, the heat radiation dissipating in the horizontal plane 25 is the greatest with a plasma melting furnace that comprises a centrally arranged plasma burner 11 projecting vertically into the interior of the furnace. The band-like damage to the lining is particularly strong with a plasma melting furnace of a conventional design. According to the present invention the heat radiation dissipating in the horizontal plane 25 is directly reflected against the bath 17 upon a single reflection so that the band-like damage will be avoided and energy will be supplied to the bath to an increased extent.

With the furnace according to the invention, therefore, not only the energy consumption has been improved, but also the heat distribution to the lining has been made uniform. In addition to the saving of energy, this leads to a longer service life of the lining. Moreover, the additional heating up of the bath with an unchanged energy supply leads to a shorter charging period, i.e. tap-to-tap time.

What is claimed is:

1. In a plasma melting furnace of the type including a furnace interior having an axis, a furnace lining surrounding said furnace interior and having an inner surface, and at least one plasma burner penetrating said furnace lining to a point above the surface of a bath within said furnace interior, in particular a plasma burner projecting vertically into said furnace interior, the improvement which is characterized in that said inner surface of said furnace lining is conical and inclined, converging upwardly at a convergent angle $\alpha$, whereby heat radiation emanating from said plasma burner on a horizontal plane perpendicular to said axis is reflected into said bath.

2. A plasma melting furnace as set forth in claim 1, wherein said convergent angle $\alpha$ amounts to between 5° and 15°.

3. A plasma melting furnace as set forth in claim 1, wherein said convergent angle $\alpha$ amounts to between 5° and 10°.

* * * * *